US008654985B2

(12) United States Patent
Villemoes et al.

(10) Patent No.: US 8,654,985 B2
(45) **Date of Patent: *Feb. 18, 2014**

(54) STEREO COMPATIBLE MULTI-CHANNEL AUDIO CODING

(75) Inventors: Lars Villemoes, Järfälla (SE); Heiko Purnhagen, Sundbyberg (SE); Jonas Roeden, Solna (SE); Jonas Engdegard, Stockholm (SE); Jeroen Breebaart, Eindhoven (NL); Erik Schuijers, Eindhoven (NL)

(73) Assignee: Dolby International AB, Amsterdam Zuid-Oost (NL)

( * ) Notice: Subject to any disclaimer, the term of this patent is extended or adjusted under 35 U.S.C. 154(b) by 274 days.

This patent is subject to a terminal disclaimer.

(21) Appl. No.: 13/040,057

(22) Filed: Mar. 3, 2011

(65) Prior Publication Data

US 2011/0211703 A1 Sep. 1, 2011

Related U.S. Application Data

(62) Division of application No. 11/286,239, filed on Nov. 23, 2005, now Pat. No. 7,916,873.

(30) Foreign Application Priority Data

Nov. 2, 2004 (SE) ..... 0402650-6

(51) Int. Cl.
*H04R 5/00* (2006.01)
*G10L 19/00* (2013.01)

(52) U.S. Cl.
USPC ..... 381/22; 704/500

(58) Field of Classification Search
USPC ..... 381/2, 19, 20, 21, 22, 23; 704/500, 501, 704/502, 503, 504; 700/94
See application file for complete search history.

(56) References Cited

U.S. PATENT DOCUMENTS

| | | | |
|---|---|---|---|
| 7,343,281 | B2 | 3/2008 | Breebaart et al. |
| 7,394,903 | B2 | 7/2008 | Herre et al. |
| 2005/0254446 | A1 | 11/2005 | Breebaart |
| 2007/0002971 | A1 | 1/2007 | Purnhagen et al. |
| 2007/0258607 | A1 | 11/2007 | Purnhagen et al. |

FOREIGN PATENT DOCUMENTS

| | | |
|---|---|---|
| RU | 2073913 C1 | 2/1997 |
| TW | 565826 | 12/2003 |
| WO | WO 2005/101370 | 10/2005 |

OTHER PUBLICATIONS

Breebaart, et al.; "Parametric Coding of Stereo Audio"; 2005; Journal on Applied Signal Processing, EURASIP.

(Continued)

*Primary Examiner* — Duc Nguyen
*Assistant Examiner* — Kile Blair
(74) *Attorney, Agent, or Firm* — Michael A. Glenn; Perkins Coie LLP

(57) ABSTRACT

A parametric representation of a multi-channel audio signal having parameters suited to be used together with a monophonic downmix signal to calculate a reconstruction of the multi-channel audio signal can efficiently be derived in a stereo-backwards compatible way when a parameter combiner is used to generate the parametric representation by combining a one or more spatial parameters and a stereo parameter resulting in a parametric representation having a decoder usable stereo parameter and an information on the one or more spatial parameters that represents, together with the decoder usable stereo parameter, the one or more spatial parameters.

15 Claims, 11 Drawing Sheets

(56) References Cited

OTHER PUBLICATIONS

Breebaart, et al.; "High-Quality Parametric Spatial Audio Coding at Low Bit Rates"; May 2004; Audio Engineering Society Convention Paper, 116th Convention, Berlin, Germany.
Faller, C.; "Coding of Spatial Audio Compatible with Different Playback Formats"; Oct. 28, 2004; Audio Engineering Society Convention Paper, 117th Aes convention; San Francisco, CA.
Faller, et al.; "Binaural Cue Coding Applied to Stereo and Multi-Channel Audio Compression"; May 2002; Audio Engineering Society Convention Paper 5574, 112th Convention; Munich, Germany.
Faller, et al.; "Binaural cue Coding: A Novel and Efficient Representation of Spatial Audio"; 2002, IEEE.
Schuijers, et al.: "Audio Engineering Society Convention Paper 6073"; May 2004; 116th Convention Berlin, Germany.
Russian Office Action with Translation for parallel application No. 2007120634/09(022468), PCT Application No. PCT/EP2005/011663 received on May 4, 2009.

STEREO COMPATIBLE MULTI-CHANNEL AUDIO CODING

CROSS-REFERENCE TO RELATED APPLICATIONS

This application is a divisional of U.S. patent application Ser. No. 11/286,239, filed Nov. 23, 2005 now U.S. Pat. No. 7,916,873, which claims priority from International Application No. PCT/EP05/011663, filed Oct. 31, 2005, the entirety of which is herein incorporated by this reference thereto.

BACKGROUND OF THE INVENTION

1. Field of the Invention

The present invention relates to multi-channel audio coding and in particular to a concept of generating and using a parametric representation of a multi-channel audio signal that is fully backwards compatible to parametric stereo playback environments.

2. Description of the Related Art

The present invention relates to coding of multi-channel representations of audio signals using spatial audio parameters in a manner that is compatible with coding of 2-channel stereo signals using parametric stereo parameters. The present invention teaches new methods for efficient coding of both spatial audio parameters and parametric stereo parameters and for embedding the coded parameters in a bitstream in a backward compatible manner. In particular it aims at minimizing the overall bitrate for the parametric stereo and spatial audio parameters in the backward compatible bitstream without compromising the quality of the decoded stereo or multi-channel audio signal. When a slightly compromised quality of the decoded stereo signal is acceptable, the overall bitrate can be reduced even further.

Recently, multi-channel audio reproduction techniques are becoming more and more important. Aiming at an efficient transmission of multi-channel audio signals having 5 or more separate audio channels, several ways of compressing a stereo or multi-channel signal have been developed. Recent approaches for the parametric coding of multi-channel audio signals (parametric stereo (PS), Binaural Cue Coding (BCC) etc.) represent a multi-channel audio signal by means of a down-mix signal (could be monophonic or comprise several channels) and parametric side information, also referred to as "spatial cues", characterizing its perceived spatial sound stage.

A multi-channel encoding device generally receives—as input—at least two channels, and outputs one or more carrier channels and parametric data. The parametric data is derived such that, in a decoder, an approximation of the original multi-channel signal can be calculated. Normally, the carrier channel (channels) will include subband samples, spectral coefficients, time domain samples, etc., which provide a comparatively fine representation of the underlying signal, while the parametric data do not include such samples of spectral coefficients but include control parameters for controlling a certain reconstruction algorithm instead. Such a reconstruction could comprise weighting by multiplication, time shifting, frequency shifting, phase shifting, etc. Thus, the parametric data includes only a comparatively coarse representation of the signal or the associated channel.

The binaural cue coding (BCC) technique is described in a number of publications, as in "Binaural Cue Coding applied to Stereo and Multi-Channel Audio Compression", C. Faller, F. Baumgarte, AES convention paper 5574, May 2002, Munich, in the 2 ICASSP publications "Estimation of auditory spatial cues for binaural cue coding", and "Binaural cue coding: a normal and efficient representation of spatial audio", both authored by C. Faller, and F. Baumgarte, Orlando, Fla., May 2002.

In BCC encoding, a number of audio input channels are converted to a spectral representation using a DFT (Discrete Fourier Transform) based transform with overlapping windows. The resulting uniform spectrum is then divided into non-overlapping partitions. Each partition has a bandwidth proportional to the equivalent rectangular bandwidth (ERB). Then, spatial parameters called ICLD (Inter-Channel Level Difference) and ICTD (Inter-Channel Time Difference) are estimated for each partition. The ICLD parameter describes a level difference between two channels and the ICTD parameter describes the time difference (phase shift) between two signals of different channels. The level differences and the time differences are normally given for each channel with respect to a reference channel. After the derivation of these parameters, the parameters are quantized and finally encoded for transmission.

Although ICLD and ICTD parameters represent the most important sound source localization parameters, a spatial representation using these parameters can be enhanced by introducing additional parameters.

A related technique, called "parametric stereo" describes the parametric coding of a two-channel stereo signal based on a transmitted mono signal plus parameter side information. Three types of spatial parameters, referred to as inter-channel intensity difference (IIDs), inter-channel phase differences (IPDs), and inter-channel coherence (IC) are introduced. The extension of the spatial parameter set with a coherence parameter (correlation parameter) enables a parametrization of the perceived spatial "diffuseness" or spatial "compactness" of the sound stage. Parametric stereo is described in more detail in: "Parametric Coding of stereo audio", J. Breebaart, S. van de Par, A. Kohlrausch, E. Schuijers (2005) Eurasip, J. Applied Signal Proc. 9, pages 1305-1322)", in "High-Quality Parametric Spatial Audio Coding at Low Bitrates", J. Breebaart, S. van de Par, A. Kohlrausch, E. Schuijers, AES 116$^{th}$ Convention, Preprint 6072, Berlin, May 2004, and in "Low Complexity Parametric Stereo Coding", E. Schuijers, J. Breebaart, H. Purnhagen, J. Engdegard, AES 116$^{th}$ Convention, Preprint 6073, Berlin, May 2004.

As mentioned above, systems for parametric stereo coding as well as for spatial audio coding have been developed recently. As in parametric stereo a two-channel stereo audio signal is represented by means of a mono downmix audio signal and additional side information that carries stereo parameters (see PCT/SE02/01372 "Efficient and scalable Parametric Stereo Coding for Low Bitrate Audio Coding Applications"), a legacy parametric stereo decoder reconstructs a two-channel stereo signal from the mono signal and the side information.

In spatial audio coding schemes, a multi-channel surround audio signal is represented by means of a mono or stereo downmix audio signal and additional side information that carries spatial audio parameters. A widely known example is the 5.1 channel configuration used for home entertainment systems.

A legacy spatial audio decoder reconstructs the 5.1 multi-channel signal based on the mono or stereo signal and the additional spatial audio parameters.

Typically downmix signals employed in parametric stereo or spatial audio coding systems are additionally encoded, using low bit rate perceptual audio coding techniques (like MPEG MC) to further reduce the required transmission bandwidth for transmission of the different signal types. Furthermore the downmix signal is normally combined with the parametric stereo or with the spatial audio side information in a bitstream in a way, that assures backward compatibility with legacy decoders, that is with decoders that are not operative to process the parametric stereo or spatial audio parameters. In this way, a legacy audio decoder only reconstructs the mono or stereo downmix signal transmitted. When a decoder implementing parametric stereo or spatial audio coding is used, the decoder will also recover the side information embedded in the bitstream and reconstruct the full two-channel stereo or 5.1 channel surround signal.

When spatial audio coding is used based on a mono downmix signal it is furthermore desirable to increase the backwards compatibility by providing a signal such that not only a legacy perceptual audio decoder can derive the mono downmix signal, but that additionally a parametric stereo decoding of such a bitstream is possible for a parametric stereo decoder that does not support spatial audio decoding. To achieve this goal, it is necessary to include both information, the parametric stereo side information and the spatial audio side information in the bitstream. This obvious approach leads to an undesirably high amount of side information within the bitstream. That would mean for a scenario where a total maximum bit rate has to be maintained to convey the mono signal and the side information, that an increase in side information would lead to less data rate available for the perceptually encoded mono downmix, which obviously reduces the audio quality of the decoded mono downmix signal.

Another prior art approach of simultaneously including both the parametric stereo and spatial audio parameters and the side information, requires a set of spatial audio parameters that are structured such, that a subset of these parameters permits to reconstruct a two-channel stereo signal from the mono downmix signal. This subset is embedded as parametric side information within the bitstream in a way compatible with parametric stereo bit streams, while remaining spatial audio parameters that do not belong to the subset are embedded as spatial audio side information in the bitstream compatible with spatial audio coders. On the decoder side, a decoder implementing only parametric stereo will reconstruct a two-channel stereo signal based on the subset of parameters that are embedded as parametric stereo side information. On the other hand, a decoder implementing spatial audio will recover the parametric stereo subset and the remaining spatial audio parameters. With this complete set of spatial parameters, the multi-channel signal can be reconstructed.

This approach, however, has the drawback that it compromises the audio quality of either the backward compatible parametric stereo reconstruction or the multi-channel reconstruction. This is evident, since in the first case, the subset of parameters that are also used as spatial audio parameters describe the interrelation between two channels of a 5.1 signal. The most natural choice would be the left-front (l) and the right-front (r) channel, which, however, can differ substantially from the correct values for the relationship of the left (l0) and right (r0) channels of a stereo downmix. In the second case the correct values of a stereo downmix form said first subset, which means that they are used to describe an interrelation between the left-front and the right-front channel of a multi-channel surround signal. This, however, can lead to a significant imperfection of the spatial audio reconstruction due to quantization of the parameters, which is required, in order to embed them in the bitstream in a multi-channel compatible way.

SUMMARY OF THE INVENTION

It is the object of the present invention to provide a concept for creating and using a parametric representation of a multi-channel audio signal that allows for a more efficient representation hardly compromising neither the quality of a parametric stereo reconstruction nor the quality of a spatial audio reconstruction.

In accordance with a first aspect, the present invention provides a multi-channel audio decoder for processing a parametric representation, wherein the parametric representation has information on one or more spatial parameters describing spatial properties of a multi-channel signal and a stereo parameter describing spatial properties of a stereo downmix of the multi-channel signal, wherein the information on the one or more spatial parameters and the stereo parameter, when combined using a combination rule, results in one or more spatial parameters, the decoder having: a parameter reconstructor for combining the stereo parameter and the information on the one or more spatial parameters using the combination rule to obtain the one or more spatial parameters.

In accordance with a second aspect, the present invention provides an encoder for deriving a parametric representation of a multi-channel audio signal, the parametric representation having parameters suited to be used together with a monophonic downmixed signal, the encoder having: a spatial parameter calculator for calculating a one or more spatial parameters describing spatial properties of the multi-channel signal; a stereo parameter calculator for calculating a stereo parameter describing spatial properties of a stereo downmix signal derived from the multi-channel signal; and a parameter combiner for generating the parametric representation by combining the one or more spatial parameters and the stereo parameters using a combination rule, wherein the parameter combiner is operative to use a combination rule resulting in a decoder usable stereo parameter and an information on the one or more spatial parameters, which represents, together with the decoder usable stereo parameter, the one or more spatial parameters.

In accordance with a third aspect, the present invention provides a method for processing a parametric representation, wherein the parametric representation has information on a one or more spatial parameters describing spatial properties of a multi-channel signal and a stereo parameter describing spatial properties of a stereo-downmix of the multi-channel signal, wherein the information on the one or more spatial parameters and the stereo parameters, when combined using a combination rule, results in the one or more spatial parameters, the method having the steps of: combining the stereo parameter and the information on the one or more spatial parameters using the combination rule to obtain the one or more spatial parameters.

In accordance with a fourth aspect, the present invention provides a method for deriving a parametric representation of a multi-channel audio signal, the parametric representation having parameters suited to be used together with a monophonic downmix signal, the method having the steps of: calculating a one or more spatial parameters describing spatial properties of the multi-channel signal; calculating a stereo parameter describing spatial properties of a stereo downmix signal derived from the multi-channel signal; and generating the parametric representation by combining the one or more spatial parameters and the stereo parameter using a combination rule, wherein using the combination rule results in a decoder usable stereo parameter and in information on the one or more spatial parameters, which represents, together with the decoder usable stereo parameter, the one or more spatial parameters.

In accordance with a fifth aspect, the present invention provides a parametric representation of a multi-channel audio signal, the parametric representation having parameters suited to be used together with a monophonic downmix signal, wherein the parametric representation is having a decoder usable stereo parameter describing spatial properties of a stereo downmix of the multi-channel signal and information on a one or more spatial parameters generated by combining a one or more spatial parameters describing spatial properties of the multi-channel audio signal and the stereo parameter such that the information on the one or more spatial parameters represents, together with the decoder usable stereo parameter, the one or more spatial parameters.

In accordance with a sixth aspect, the present invention provides a computer readable storage medium having stored thereon the above-mentioned parametric representation of a multi-channel audio signal.

In accordance with a seventh aspect, the present invention provides a transmitter or audio recorder having the above-mentioned encoder for deriving a parametric representation of a multi-channel audio signal.

In accordance with an eighth aspect, the present invention provides a receiver or audio player having the above-mentioned multi-channel audio decoder.

In accordance with a ninth aspect, the present invention provides a method of transmitting or audio recording, the method having the above-mentioned method for deriving a parametric representation of a multi-channel audio signal.

In accordance with a tenth aspect, the present invention provides a method of receiving or audio playing, the method having the above-mentioned method for processing a parametric representation.

In accordance with an eleventh aspect, the present invention provides a transmission system having a transmitter and a receiver; the transmitter having the above-mentioned encoder for deriving a parametric representation of a multi-channel audio signal; and the receiver having the above-mentioned multi-channel audio decoder.

In accordance with a twelfth aspect, the present invention provides a method of transmitting and receiving, the method including a transmitting method having the above-mentioned method for deriving a parametric representation of a multi-channel audio signal; and a receiving method, having the above-mentioned method for processing a parametric representation.

In accordance with a thirteenth aspect, the present invention provides a computer program for performing, when running on a computer, one of the above-mentioned methods.

The present invention is based on the finding that a parametric representation of a multi-channel audio signal having parameters suited to be used together with a monophonic downmix signal can efficiently be derived in a backwards compatible way when a parameter combiner is used to generate the parametric representation by combining a set of spatial parameters and a stereo parameter resulting in a parametric representation having a decoder usable stereo parameter and an information on the set of spatial parameters that represents, together with the decoder usable stereo parameter, the set of spatial parameters.

By using an interrelation between the spatial parameters and the stereo parameters that are describing a stereo downmix of the same multi-channel audio signal also described by the spatial parameters, one can advantageously predict a subset of the spatial parameters based on the parametric stereo parameters.

Since the two-channel stereo signal described by the stereo parameters represents some form of a stereo-downmix of the 5.1 multi-channel signal, there are dependencies between the stereo parameters of the parametric stereo system and the spatial parameters of the spatial audio coding system, as mentioned above. The present invention uses these stereo parameters in combination with a subset of the spatial audio parameters to predict the values of the remaining spatial audio parameters not enclosed in said subset. Then, only the difference between the predicted and the actual values of the spatial audio parameters not in the subset needs to be conveyed. The entropy of this difference (i.e. the prediction error) is typically less than the entropy of the actual parameter itself. This may be used by a system employing the present invention and some sort of subsequent entropy coding. Such a system requires less side information bit rate for the parametric stereo and spatial audio parameters than a system that would simply embed all parameters independently. It is to be noted that at the same time, such a system employing the present invention does neither compromise the quality of the parametric stereo reconstruction nor the quality of the spatial audio reconstruction.

As it is the goal to provide a parametric representation that is backwards compatible to parametric stereo decoders, it is preferred that the correct parameters representing the stereo-downmix should be used in order not to compromise the quality of the two-channel stereo signal reconstructed from a parametric stereo decoder. Nevertheless, in an alternative embodiment of the present invention, a small modification of the parametric stereo parameters is employed in the encoder, based on the estimated spatial parameters, in order to improve the performance of the parameter prediction for the spatial audio parameters. It is clear that this modification of the parametric stereo (PS) parameters leads, to a slightly reduced quality of the stereo signal reconstructed by a decoder only implementing parametric stereo decoding. By this embodiment of the present invention, the quality of the reconstructed spatial audio signal remains unaffected by the PS parameter modification, while the overall bit rate required for the PS and spatial side information embedded in a compatible bitstream is reduced.

In a preferred embodiment of the present invention, an encoder for deriving a parametric representation of a multi-channel audio signal is used that generates a bitstream, in which spatial audio parameters as well as parametric stereo parameters of a stereo downmix of the multi-channel signal are embedded in a fully backwards compatible way. That is, a parametric stereo decoder able to process parametric stereo parameters only, will be able to reconstruct a high quality stereo signal using the parametric stereo parameters. Furthermore, the inventive encoder replaces some of the spatial parameters by a differential representation of the actual spatial parameters and a prediction of the spatial parameter, whereas the prediction of the spatial parameter is based on the stereo parameters and on a set of the spatial audio parameters not replaced. Since both the spatial audio parameter representation as well as the parametric stereo representation parameters describe level differences and correlation between channel pairs, there is an interrelation between the spatial audio parameters and the stereo parameters, as both of them are derived from the same data basis, i.e. the multi-channel signal. Hence, by using the difference between the prediction and the real value for transmission, bit rate can be saved, since the differences normally have an entropy that is much smaller than the entropy of the underlying spatial audio parameter. When the prediction is perfect the difference of the prediction and the real value is obviously zero, which means that as representation of the replaced spatial parameters only zero values have to be transmitted or stored within the parametric representation, which is most advantageous when further entropy coding steps are performed on the representation, as it is usually the case.

By using the concept described above, an inventive encoder or decoder has the obvious advantage that despite the backwards compatible transmission of spatial audio and parametric stereo parameters without loss in precision, the bit rate can be decreased in comparison to a scenario, where the spatial audio parameters and parametric stereo parameters are simply transmitted independently within a bitstream.

In a further embodiment of the present invention, a small change is applied to the parametric stereo parameters prior to the prediction of the spatial parameters and the transmission of the altered spatial parameters. This has the great advantage that the stability of the prediction can be improved by the small change of the parametric stereo parameters and, hence, the overall bit rate can be further decreased. The cost is a small degradation in the quality of a stereo upmix reconstructed using the modified stereo parameters, since the actually optimal parametric stereo parameters are changed within the encoding process.

In a further embodiment of the present invention, an inventive audio encoder comprises a spatial downmixer to generate a monophonic signal from a multi-channel signal input into the encoder. The monophonic signal is further compressed by an audio encoder, using e.g. perceptual audio compression, to further decrease the bit rate the monophonic downmix signal uses during transmission. A bitstream generator finally generates a bitstream to combine the mono signal, the spatial audio parameters and the parametric stereo parameters into a single, parametric stereo compatible bitstream.

In a further embodiment of the present invention, a parametric encoder or decoder comprises a control unit, allowing for a further decrease of the required bit rate. This is achieved by comparing the bit rate needed by the differential representation of the spatial parameters generated by using the difference of the actual spatial parameter and a prediction of the same with the bit rate needed for directly encoding the spatial parameters. Encoding is performed by means of a two-step encoding procedure, firstly comprising time and/or frequency differential encoding of each parameter individually, and a subsequent entropy encoding (using e.g. a Huffman encoder, an arithmetic encoder or a run-length encoder). This process exploits predictability (or redundancy) for each parameter based on its own history (as compared to prediction across parameter sets as described above). In the cases where the differential predictive encoding results in a higher bit rate, further bit rate can be saved by directly transmitting the spatial parameters for given time frames. The decision, which strategy was chosen, can either be transmitted within the bit stream to be processed on the decoder side or the decoder may decide without notification, which strategy had originally been used by applying appropriate detection algorithms.

As already mentioned, a signal generated according to the present invention has the great advantage of being backwards compatible to a parametric stereo decoder and furthermore holding the information required for the reproduction of a full spatial (surround) signal when transmitted to an inventive decoder.

Therefore, an inventive decoder receiving the parametric stereo parameters and the spatial audio parameters can reconstruct a full set of spatial parameters by applying the same prediction and reverse transformation of the differentially transmitted spatial audio parameters to derive the full set of spatial audio parameters representing the spatial property of a multi-channel signal from an inventive bitstream.

In other words, the combination rule used to combine the parametric stereo parameters and the received spatial audio parameters to reconstruct a full set of spatial parameters is the inverse of the rule applied at an encoder side. In the case of differential encoding as mentioned above, this would mean, that first the prediction of the desired parameter is calculated using one or more of the parametric stereo parameters and one or more of the received spatial audio parameters. Then, the sum between the predicted value and the transmitted value is computed, this sum being the desired parameter of the full set of spatial parameters.

In a further embodiment of the present invention, an inventive decoder is able to also reconstruct a stereo representation of the multi-channel signal using the high quality parametric stereo parameters. This has the great advantage that an inventive decoder can be configured according to the needs, i.e. when only a stereo playback environment is available, a high quality stereo signal can be reproduced by an inventive decoder, whereas, when a multi-channel playback environment is at hand, the multi-channel representation of the signal may be reproduced to allow for the enjoyable listening to surround sound.

In a further embodiment of the present invention, an inventive encoder is comprised within a transmitter or audio recorder, allowing for bit rate saving storage or transmission of an audio signal, that may be reproduced with excellent quality either as a stereo signal or as full surround signal.

In a further embodiment of the present invention, an inventive decoder is comprised within a receiver or audio player, allowing to receive or playback signals using different loudspeaker setups, wherein the audio signal can be reproduced in the representation fitting the existing playback environment best.

Summarizing, the present invention comprises the following advantageous features:

- compatible coding of multi-channel audio signals, including,
- at the encoder side, downmixing the multi-channel signal to a one channel representation,
- at the encoder side given said multi-channel signal, definition of parameters representing the multi-channel signal,
- at the encoder side given said multi-channel signal, definition of parameters representing a stereo downmix of the multi-channel signal,
- at the encoder side, embedding both sets of parameters in a bitrate efficient and backward compatible manner in a bitstream,
- at the decoder side, extracting the embedded parameters from a bitstream,
- at the decoder side, reconstructing parameters representing a multi-channel signal from the parameters extracted from the bitstream,
- at the decoder side, reconstructing the multi-channel output signals given the parameters reconstructed from the bitstream data, and said downmixed signal;
- embedding the parameters representing a stereo downmix in the bitstream, such that they can be decoded by a (legacy) decoding method that only supports parametric stereo decoding;
- splitting the set of parameters representing the multi-channel signal in a first subset and a second subset;
- predicting of the values in said first subset of parameters based on said second subset of parameters and based on the parameters that represent a stereo downmix of the multi-channel signal;
- a controlling mechanism that automatically selects whether the first subset of parameters is encoded directly or whether only the differences relative to the predicted parameter values are encoded;

modification of the parameters that represent a stereo downmix, where both the original parameters representing the multi-channel signal and the original parameters representing the stereo downmix are used as basis to derive the modified parameters;

a look-up table being used to find said predicted parameter values;

a polynomial function being used to find said predicted parameter values;

a mathematical function derived from the method employed to generate the stereo downmix being used to find said predicted parameter values.

DETAILED DESCRIPTION

The below-described embodiments are merely illustrative for the principles of the present invention for improved parametric stereo compatible coding of spatial audio. It is understood that modifications and variations of the arrangements and the details described herein will be apparent to others skilled in the art. It is the intent, therefore, to be limited only by the scope of the impending patent claims and not by the specific details presented by way of description and explanation of the embodiments herein.

Figure 1:
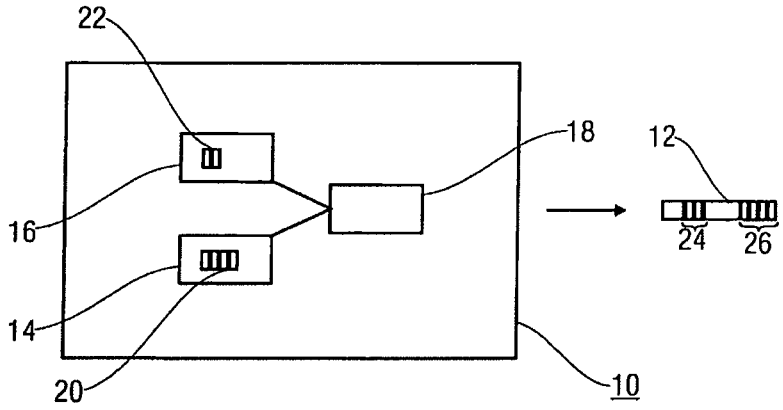
FIG. 1 is a block diagram of an inventive encoder.

FIG. 1 shows an inventive encoder 10 for deriving a parametric representation 12 of a multi-channel audio signal. The encoder 10 is comprising a spatial parameter calculator 14, a stereo parameter calculator 16 and a parameter combiner 18.

The spatial parameter calculator 14 calculates a set of spatial parameters 20 describing the spatial properties of a multi-channel signal. The stereo parameter calculator 16 is calculating stereo parameters 22 describing spatial properties of a stereo downmix of the multi-channel signal. The set of spatial parameters 20 and the stereo parameters 22 are transferred to the parameter combiner 18 that is deriving the parametric representation 12, which comprises a decoder usable stereo parameter 24 and an information on the set of spatial parameters 26.

Figure 2:
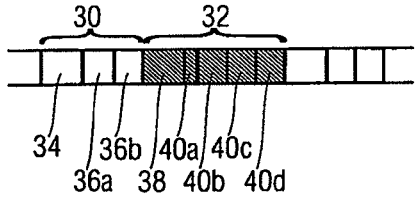
FIG. 2 is a generated bitstream according to the present invention.

FIG. 2 is showing an example for a backwards compatible bitstream being the parametric representation of a multi-channel audio signal as produced by an inventive encoder according to FIG. 1. The bitstream is comprising a stereo parameter section 30 and a spatial parameter section 32. The stereo parameter section 30 is having a stereo header 34 at the beginning of the stereo parameter section 30, followed by two decoder usable stereo parameters 36*a* and 36*b*, that would be used by a parametric stereo decoder to reconstruct the stereo signal. A decoder being able to process parametric stereo parameters only would identify the parametric stereo parameters 36*a* and 36*b* by the information comprised in the stereo header 34.

The spatial audio section 32 begins with a spatial header 38 and comprises four spatial audio parameters 40*a* to 40*d*. A multi-channel decoder according to the present invention would use the spatial parameters 40*a* to 40*d* by identifying them with the help of the spatial header 38 as well as the stereo parameters 36*a* and 36*b* as identified by the stereo header 34. As indicated in FIG. 2, the spatial parameter 40*a* consumes less bitrate than the spatial parameters 40*b* to 40*d*. In the example shown in FIG. 2, the spatial parameter 40*a* is represented by the difference of the underlying original spatial parameter, and a predicted spatial parameter derived using one or more of the stereo parameters 36*a* or 36*b* and one or more of the spatial audio parameters 40*b* to 40*d*. An inventive multi-channel decoder would therefore need to use both the stereo parameters 36*a* and 36*b* and the spatial parameters 40*b* to 40*d* to reconstruct the spatial parameter underlying the information on the spatial parameter 40*a* that is transmitted in the bitstream.

Figure 3:
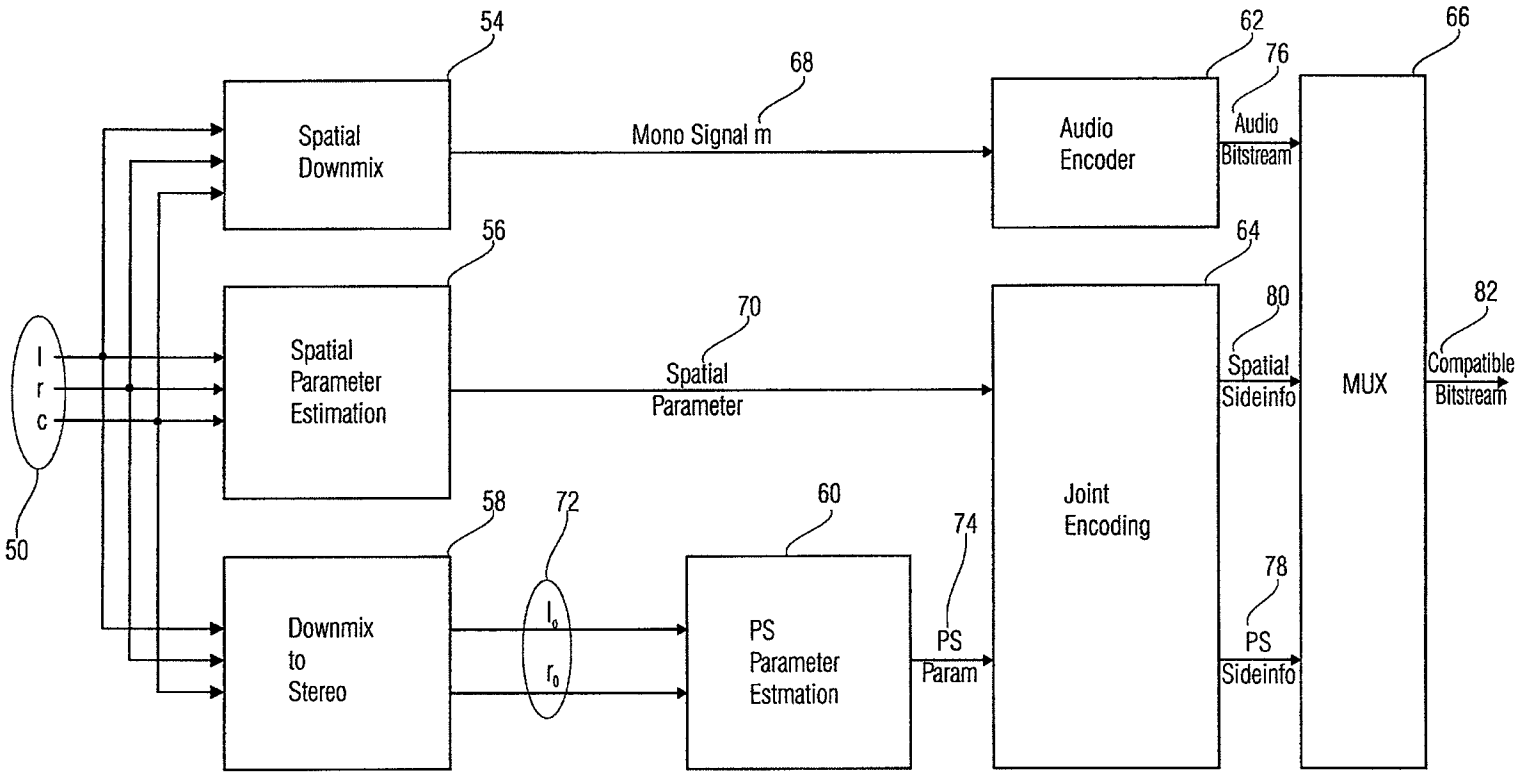
FIG. 3 is a further embodiment of an inventive encoder.

FIG. 3 is showing a preferred embodiment of an inventive encoder 52 for deriving a parametric representation of a multi-channel audio signal 50, that is having three channels, a left channel l, a right channel r and a center channel c.

The inventive encoder 52 is comprising a spatial downmixer 54, a spatial parameter estimator 56, a stereo downmixer 58, a parametric stereo parameter estimator 60, an audio encoder 62, a parameter combiner (joint encoding block) 64 and a bitstream calculator (multiplexer) 66.

The spatial downmixer 54, the spatial parameter estimator 56 and the stereo downmixer 58 receive as an input the multi-channel signal 50. The spatial downmixer 54 creates a monophonic downmix signal 68 from the multi-channel signal 50, the spatial parameter estimator 56 derives spatial parameters 70 describing spatial properties of the multi-channel signal, and the stereo downmixer 58 creates a stereo downmix signal 72 from the multi-channel signal 50.

The stereo downmix signal 72 is input to the parametric stereo parameter estimator 60, which derives stereo parameters 74 from the stereo downmix signal describing spatial properties of the stereo downmix signal 72. The monophonic downmix signal 68 is input into the audio encoder 62 that derives an audio bitstream 76 representing the monophonic downmix signal 68 by means of encoding, using for example perceptual audio encoding techniques. The parameter combiner 64 receives as an input the spatial parameters 70 as well as the parametric stereo parameters 74 and derives as an output decoder usable stereo parameters (parametric stereo side information) 78 and information on the spatial parameters (spatial side info) 80 by replacing sets of spatial parameters by the difference of a prediction of the spatial parameters and the spatial parameters themselves. This will be described in more detail by the following Figure.

The bitstream calculator 66 finally receives as an input the audio bitstream 76, the information on the set of spatial parameters 80 and the decoder usable stereo parameters 78 and combines said input into a parametric stereo compatible bitstream 82, that could for example comprise segments of parameters as detailed in FIG. 2.

The bit stream calculator 66 can be a simple multiplexer. Nonetheless other means to combine the three inputs into a compatible bitstream may also be implemented to derive a bitstream according to the present invention.

In other words, FIG. 3 illustrates an encoder that takes a multi-channel audio signal, comprising the channels l, r, and c, as input and generates a compatible bitstream that permits decoding by a spatial decoder as well as backward-compatible decoding by a PS decoder. The spatial downmix takes the multi-channel signal l, r, c and generates a mono downmix signal m. This signal can then be encoded by an optional perceptual audio encoder to produce a compact audio bitstream representing the mono signal. The spatial parameter estimation takes the multi-channel signal l, r, c as input and generates a set of quantized spatial parameters. These parameters can be a function of time and frequency. The downmix to stereo produces a 2-channel stereo downmix l0, r0 of the multi-channel signal, for example using the ITU-R downmix equations or alternative approaches. The parametric stereo (PS) parameter estimation takes this stereo downmix as input and generates a set of quantized PS parameters, which can be a function of time and frequency. The joint encoding block takes both the spatial parameter and the PS parameter as input and produces the parametric stereo side information (PS side info) and the spatial side info. Finally a multiplexer takes the audio bitstream and both the spatial and PS side info bitstreams as input and embeds the side information in such a way in the bitstream that backward compatible decoding by legacy decoder (only implementing PS) is possible.

Figure 4:
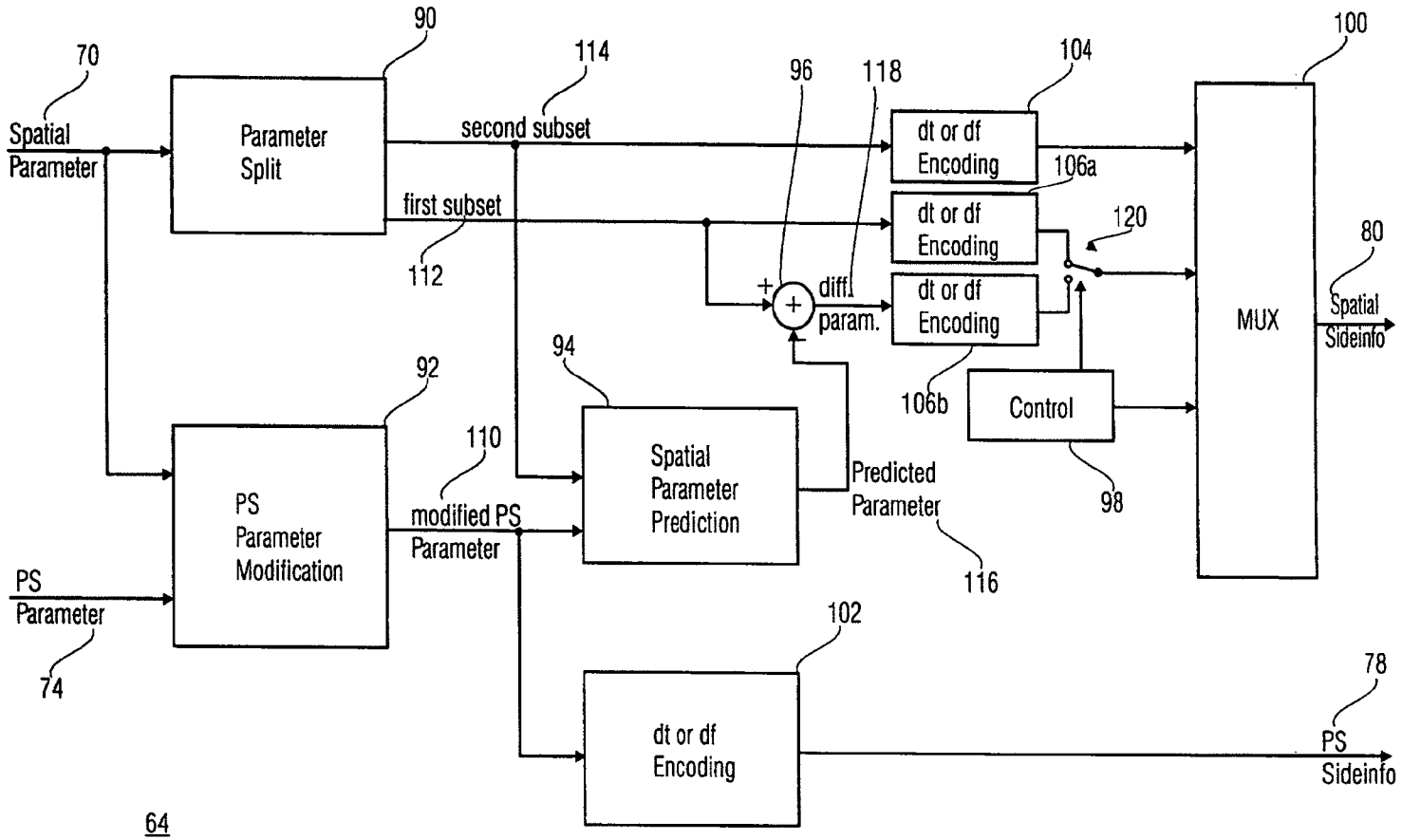
FIG. 4 is details of the inventive encoder of FIG. 3.

FIG. 4 details the parameter combiner 64 shown in FIG. 3. The parameter combiner 64 is having a parameter splitter 90, a parametric stereo parameter modifier 92, a spatial parameter predictor 94, a combiner 96, a control unit 98, a spatial parameter assembler 100 and a first differential encoder 102, a second differential encoder 104, a third differential encoder 106*a* and a fourth differential encoder 106*b*.

The parameter combiner 64 receives as input the spatial parameters 70 and the parametric stereo parameters 74. The parametric stereo parameters 74 are input into the parametric stereo parameter modifier 92 at a first input of the same, and the spatial parameters 70 are input into the parametric stereo parameter modifier 92 at a second input. The spatial parameters 70 are furthermore input into the parameter splitter 90. The parametric stereo parameter modifier 92 is an optional device, that may be used to derive decoder usable stereo parameters 110 by modifying the parametric stereo parameters 74 using information of the spatial parameters 70.

The parameter splitter 90 divides the spatial parameters 70 into a first subset 112 of the spatial parameters and into a second subset 114 of the spatial parameters, wherein the first subset 112 is the subset of the spatial parameters that may be replaced by a differential prediction within the final parametric representation of the multi-channel signal.

As the prediction of the parameters within the first subset is performed using the decoder usable stereo parameters 110 and the second subset 114 of the spatial parameters both the decoder usable parameters 110 and the second subset of spatial parameters 114 are input into the spatial parameter predictor 94. The spatial parameter predictor 94 is deriving predicted parameters 116 using the decoder usable parametric stereo parameters 110 and the second subset of the spatial parameters 114. The predicted parameters 116 are a prediction of the parameters of the first subset 112 and are to be compared with the parameters of the first subset 112.

Therefore, the difference of the predicted parameters 116 and the first subset of parameters 112 is computed parameter-wise by the combiner 96, that is such deriving difference parameters 118. The first subset of parameters 112 is input into the third differential encoder 106*a* that differentially encodes the first subset of parameters either by applying differential encoding in time or in frequency. The differential parameters 118 are input into the fourth differential encoder 106*b*.

According to the preferred embodiment of the present invention shown in FIG. 4, the differentially encoded representation of the first subset 112 is compared to the differentially encoded representation of the differential parameters 118 by the control unit 98 to estimate, which representation requires more bits within a bitstream. The control unit 98 controls a switch 120, to supply that representation of the first subset 112 to the spatial parameter assembler 100 that requires less bits, whereas the information which representation was used is additionally transferred from the control unit 98 to the spatial parameter assembler 100.

The second subset 114 of the spatial parameters is also differentially encoded by the second differential encoder 104, and the differentially encoded representation of the second subset 114 is input into the spatial parameter assembler 100, that is such having the full information on the spatial parameters 70. The spatial parameter assembler 100 finally derives the information on the spatial parameters 80 by reassembling the representations of the first subset 112 and the second subset 114 into the information on the set of spatial parameters 80 that is holding the full information on the spatial parameters 70.

The final information on the set of spatial parameters 80 is, therefore comprising a second subset of spatial parameters that are unmodified despite a differential encoding of the same and a representation of the first subset of spatial parameters, that may either be the differentially encoded representation of the first subset 112 directly or a differentially encoded representation of differential parameters 118, depending on which representation requires less bit rates.

The decoder usable parametric stereo parameters 78 that are derived by an inventive parameter combiner 64, are derived by the first differential encoder 102. The first differential encoder 102 receives as an input the modified parametric stereo parameters 110 and derives the decoder usable parametric stereo parameters 78 by differentially encoding the modified parametric stereo parameters 110.

In other words, FIG. 4 illustrates the joint encoding block which takes both the spatial parameter and the PS parameter as input and generates both the spatial side info and the PS side info. An optional PS parameter modification block takes both the spatial parameter and the PS parameter as input and generates modified PS parameter. This permits to achieve better prediction of spatial parameter at the cost of compromising the quality of the 2-channel stereo signal reconstructed from the modified PS parameter. If the PS parameter modification block is not employed, the incoming PS parameter directly serve as input to the spatial parameter prediction block and to the PS encoding. The (modified) PS parameter set can be encoded using time-differential (dt) or frequency-differential (df) encoding, i.e., coding of differences of subsequent parameters in time or frequency direction respectively, and Huffman encoding, i.e., lossless entropy coding, in order to minimize the number of bits required to represent the parameter set. The parameter split block separates the set of spatial parameter in a second subset that is encoded directly and a complementary first subset that contains all remaining parameters and which can be encoded utilizing parameter prediction. The spatial parameter prediction block takes the second subset of the spatial parameter and the (modified) PS parameter as input and calculates predicted values for the first subset of the spatial parameter. These predicted values are then subtracted from the actual values of the spatial parameters in the first subset, resulting in a set of prediction error values.

The second parameter subset can be encoded using time or frequency-differential encoding and Huffman encoding in order to minimize the number of bits required to represent the parameter subset. The first parameter subset can be encoded using time or frequency-differential encoding and Huffman encoding in order to minimize the number of bits required to represent the parameter subset. The prediction error values for the first parameter subset can be encoded using time or frequency-differential encoding and Huffman encoding in order to minimize the number of bits required to represent the parameter subset. A control block selects either whether first parameter subset should be encoded directly or whether the prediction error should be encoded in order to minimize the number of bits required to represent the first parameter subset. This selection can be done individually for each parameter in the subset. The actual selection decision can either be conveyed as side information in the bitstream or can be based on rules that are part of the spatial parameter prediction. In the latter case, this decision does not have to be conveyed as side information. Finally, a multiplexer combines all encoded data to form the spatial side info.

To use the inventive concept of encoding or decoding, different implementations of the prediction of the parameters are feasible. Generally, one has the possibility to use an appropriately designed look-up table to derive a prediction of the first subset of the spatial parameters from the stereo parameters and the second subset of the spatial parameters or one could alternatively apply an analytic function to derive the predicted parameters based on the knowledge of the specific downmix processes and the ways the spatial parameters and the stereo parameters are derived. The following paragraphs give an overview of some specific examples of achieving an appropriate prediction.

This overview is based on a multi-channel signal having three channels, l: Left, c: Center, r: Right, which is to be considered as an example only. The presented principles obviously apply correspondingly also to other channel configurations. For example, in case of a 5.1 channel configuration, the Left Front and Left Surround channel can be combined using a parametric stereo module to form the left signal (l), the Right Front and Right Surround channel can be combined using a parametric stereo module to form the right signal (r), and the Center Front and Low Frequency Enhancement channel can be combined using a parametric stereo module to form the center signal (c).

The following description discusses the spatial parameter prediction block in more detail. The 2 channels of the stereo downmix signal are denoted:

$l_0$: Left Downmix, $r_0$: Right Downmix, and the mono downmix is denoted m: Mono Downmix.

The prediction block outputs predicted values $\hat{s}_1, \ldots, \hat{s}_K$ of the first K quantized spatial parameters $s_1, \ldots, s_K$ (i.e., a first subset of the spatial parameters), given the quantized modified or unmodified PS parameters $p_1$, $p_2$ and a second subset $s_{K+1}, s_{K+2}, \ldots s_N$ of the remaining quantized spatial parameters.

In the most general sense, it consists of a tabulated function (look-up table)

$$(\hat{s}_1, \ldots, \hat{s}_K)=F(p_1,p_2,s_{K+1},s_{K+1}, \ldots, s_N) \tag{1}$$

The difference signal is then equal to the prediction error $$(d_1, \ldots, d_K)=(s_1-\hat{s}_1, \ldots, s_K-\hat{s}_K) \tag{2}$$

A first design method is to let F be a tabulated function or a multivariate polynomial chosen so as to minimize the prediction error in the least squares sense over a large database of parameters. Alternatively, F can be chosen so as to minimize the resulting bitrate required to represent the first subset of spatial parameters, where a large database of parameters is used as training data to find the optimal F in this sense. Before use in the prediction unit, such a tabulated function or polynomial can be followed by a rounding or quantization operation in order to produce integer results.

An important special case of this is the use of a linear prediction where F is a polynomial of degree one.

A second class of predictor designs are those that take into account the actual parameter structure used. In the preferred embodiment of the invention, K=2 and N=4, and the parameters convey information according to:

$p_1$: iid_l0_r0 Interchannel intensity difference (IID) between channels $l_0$ and $r_0$;

$p_2$: icc_l0_r0 Interchannel coherence or cross-correlation (ICC) between channels $l_0$ and $r_0$;

$s_1$: iid_l_r Interchannel intensity difference (IID) between channels l and r;

$s_2$: icc_l_r Interchannel coherence or cross-correlation (ICC) between channels l and r;

$s_3$: iid_lr_c Interchannel intensity difference (IID) between channels l+r and c;

$s_4$: icc_lr_c Interchannel coherence or cross-correlation (ICC) between channels l+r and c.

The first example of such a design is a special case of the linear predictor design above and consists of simply putting $$\hat{s}_1=p_1,\hat{s}_2=p_2 \tag{3}$$

This simple predictor has the advantage that it result in a more stable prediction error (rather than a minimal prediction error) which is well suited for the time-differential or frequency-differential coding of said prediction error. This is true for all predictors like polynomials mentioned above.

The second example is based on the assumption that the stereo downmix is produced by $$l_0=l+q\cdot c, r_0=r+q\cdot c, \tag{4}$$

with a known center channel gain q, (typically 1 or $1/\sqrt{2}$). All signals l, r, c are finite length vectors typically resulting from a time and frequency interval of subband samples from a complex modulated filter bank analysis of time signals. For complex vectors x, y, the complex inner product and squared norm is defined by $$\left\{\begin{aligned} &\langle x, y\rangle = \sum_n x(n)y*(n), \\ &X = \|x\|^2 = \langle x, x\rangle = \sum_n |x(n)|^2, \\ &Y = \|y\|^2 = \langle y, y\rangle = \sum_n |y(n)|^2, \end{aligned}\right\} \tag{5}$$

where the star denotes complex conjugation. The linear and non-quantized versions of the IID parameters are then assumed to be obtained by $$P_1 = \sqrt{\frac{L_0}{R_0}}, S_1 = \sqrt{\frac{L}{R}}, S_3 = \sqrt{\frac{L+R}{C}}. \tag{6}$$

For the ICC parameters, in the case of cross-correlation, the formulas are $$P_2 = \frac{\mathrm{Re}\langle l_0, r_0\rangle}{\sqrt{L_0 \cdot R_0}},\ S_2 = \frac{\mathrm{Re}\langle l, r\rangle}{\sqrt{L \cdot R}},\ S_4 = \frac{\mathrm{Re}\langle l + r, c\rangle}{\|l + r\| \cdot \|c\|}. \tag{7}$$

In the case of coherence, the real value operations are replaced with absolute value (complex magnitude) operations in the formulas (7).

Assuming for simplicity that $\langle l,c\rangle = \langle r,c\rangle = 0$, it follows that $L_0 = L + q^2C$ and $R_0 = R + q^2C$ which can be inserted in the first formula of (6). By solving two equations with two unknowns, the following estimates of X=L/C and Y=R/C from $P_1$ and $S_3$ are then obtained, $$\hat{X} = \frac{P_1^2 S_3^2 + q^2(P_1^2 - 1)}{P_1^2 + 1},\ \hat{Y} = \frac{S_3^2 - q^2(P_1^2 - 1)}{P_1^2 + 1} \tag{8}$$

When both values in formula (8) are positive, the estimate of $S_1$ is formed as $\hat{S}_1 = \sqrt{\hat{X}/\hat{Y}}$. Here, the required linear parameter values are obtained by dequantizing the given integer parameters and the integer parameter estimate $\hat{s}_1$ is then obtained by quantization of $\hat{S}_1$.

When a slightly compromised quality of the decoded stereo signal is acceptable, the overall bitrate can be reduced further by employing modification of the parametric stereo parameters. The purpose of this modification is to achieve more stable prediction of the first subset of spatial parameters and reduced prediction error. It can be seen as a means to stabilize above computations. The most extreme case of such a parameter modification would be to use $p_1' = s_1$, $p_2' = s_2$ where $p_1'$, $p_2'$ denote the modified parametric stereo parameters. Since this parameter modification operation is carried out only at the encoder side, no special care needs to the taken on the decoder side.

A more general approach incorporates the complete power and correlation structure information available in $P_1$, $P_2$, $S_3$, $S_4$ via formulas (6) and (7) to obtain estimates of $S_1$ and $S_2$. By the scaling invariance of parameters, there is no loss of generality in assuming for computational purposes that C=1. Then with the definitions $$a = Re\langle l,c\rangle,\ b = Re\langle r,c\rangle,\ \rho = Re\langle l,r\rangle, \tag{9}$$

the following system of equations arises:

$$\left\{\begin{array}{c} L + q^2 + 2qa = P_1^2(R + q^2 + 2qb) \\ \rho + q^2 + 2q(a + b) = P_2(L + q^2 + 2qa)^{1/2}(R + q^2 + 2qb)^{1/2} \\ L + R = S_3^2 \\ a + b = S_4(L + R + 2\rho)^{1/2}. \end{array}\right\} \tag{10}$$

The unknowns of interest for estimation are L, R, ρ and a, b are additional unknowns. This (underdetermined) system of equation can be used as guidance for a multitude of prediction formulas, depending on the selection of restrictions on the pair a, b. For instance, the first and third equation of (10) imply $$\left\{\begin{array}{c} (1 + P_1^2)L = q^2(P_1^2 - 1) + 2q(P_1^2 b - a) + P_1^2 S_3^2 \\ (1 + P_1^2)R = S_3^2 - q^2(P_1^2 - 1) - 2q(P_1^2 b - a) \end{array}\right\} \tag{11}$$

so the computations that lead to formulas (8) corresponds to the case where $P_1^2 b = a$. More generally, a heuristic parameter γ defines a restriction on the pair a, b via $\gamma = P_1^2 b - a$.

It is again emphasized that the above prediction schemes are only examples for possible prediction schemes that can be implemented as well on an encoder side as on a decoder side.

Figure 5:
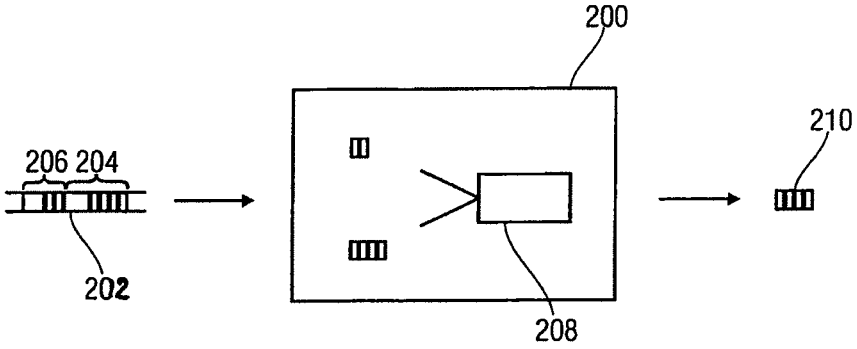
FIG. 5 is an inventive decoder.

FIG. 5 shows an inventive multi-channel audio decoder 200 for processing a parametric representation 202.

The parametric representation 202 is comprising information on a set of spatial parameters 204 describing the spatial properties of a multi-channel signal and decoder usable stereo parameters 206 describing spatial properties of a stereo downmix of the multi-channel signal. The inventive multi-channel audio decoder 200 is having a parameter reconstructor 208 for combining the decoder usable stereo parameters 206 and the information on the set of spatial parameters to obtain spatial parameters 210.

Figure 6:
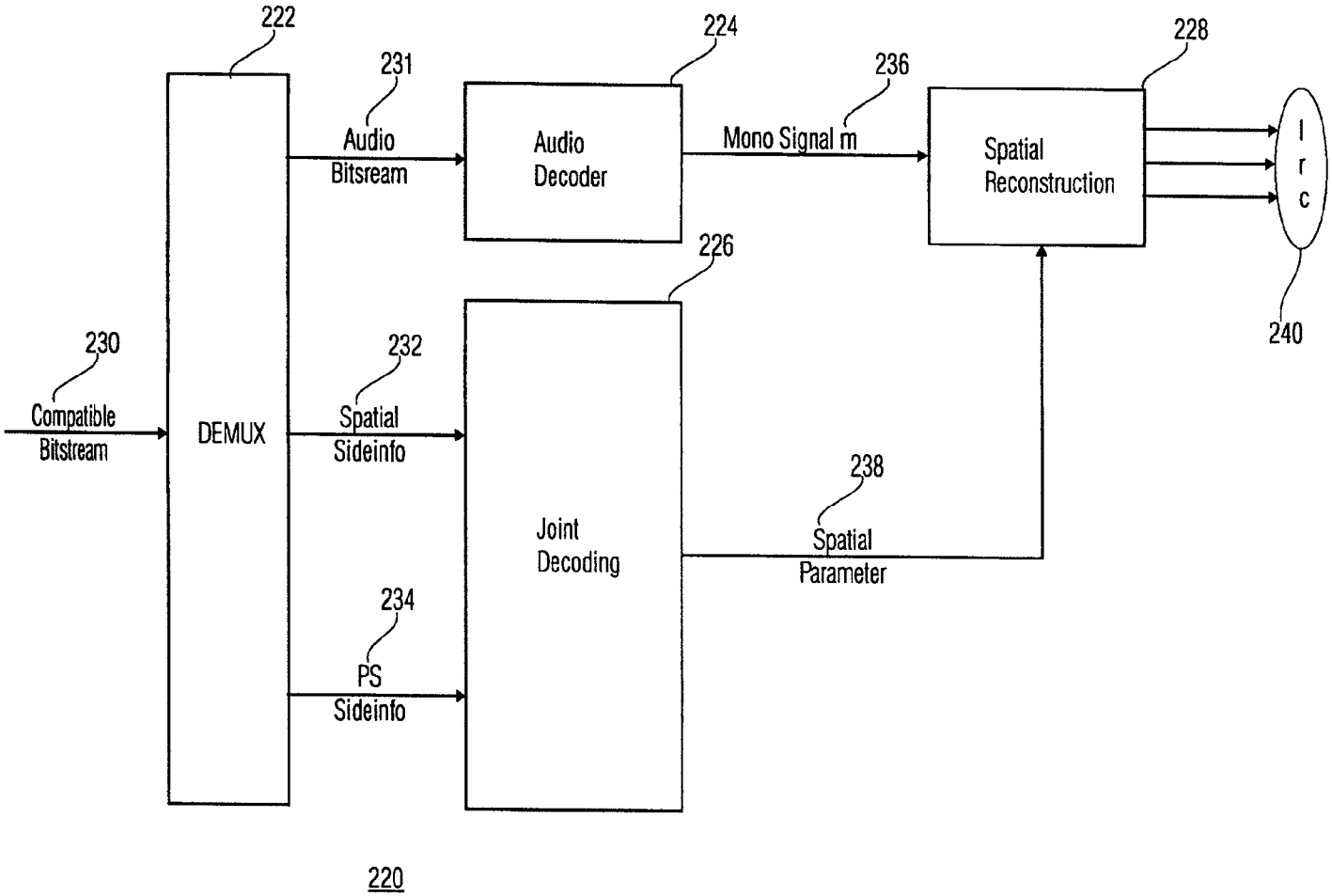
FIG. 6 is a preferred embodiment of an inventive multi-channel decoder.

FIG. 6 shows an embodiment of a multi-channel audio decoder 220 according to the present invention. The multi-channel audio decoder 220 is having a bitstream decomposer (demultiplexer) 222, an audio decoder 224, a parameter reconstructor (joint decoder) 226 and an upmixer 228.

The bitstream decomposer 222 receives a backwards compatible bitstream 230 comprising an audio bitstream 231, information on a set of spatial parameters 232 and decoder usable stereo parameters (PS side info) 234. The bitstream decomposer decomposes or demultiplexes the backwards compatible bitstream 230 to derive the audio bitstream 231, the information on the set of spatial parameters 232 and the decoder usable stereo parameters 234. The audio decoder 224 receives the audio bitstream 231 as input and derives a monophonic downmix signal 236 from the audio bitstream 231.

The parameter reconstructor 226 receives the information on the set of spatial parameters 232 and the decoder usable stereo parameters 234 as an input. The parameter reconstructor 226 combines the information on the set of spatial parameters and the decoder usable stereo parameters to derive a set of spatial parameters 238 that serves as an input to the upmixer 228, which further receives the monophonic downmix signal 236 as second input. Based on the spatial parameters 238 and on the monophonic downmix signal 236, the upmixer 228 derives a reconstruction of a multi-channel signal 240 at its output.

FIG. 6 therefore illustrates a spatial audio decoder that takes a compatible bitstream as input and generates the multi-channel audio signal, comprising the channels l, r, and c. First a demultiplexer takes the compatible bitstream as input and decomposes it into an audio bitstream and both the spatial and PS side info. If perceptual audio coding was applied to the mono signal, a corresponding audio decoder takes the audio bitstream as input and generates the decoded mono audio signal m, subject to distortion as introduced by the perceptual audio codec. The joint decoding block takes both the spatial and PS side info as input and reconstructs the spatial parameters. Finally the spatial reconstruction takes the decoded mono signal m and the spatial parameters as input and reconstructs the multi-channel audio signal.

Figure 7:
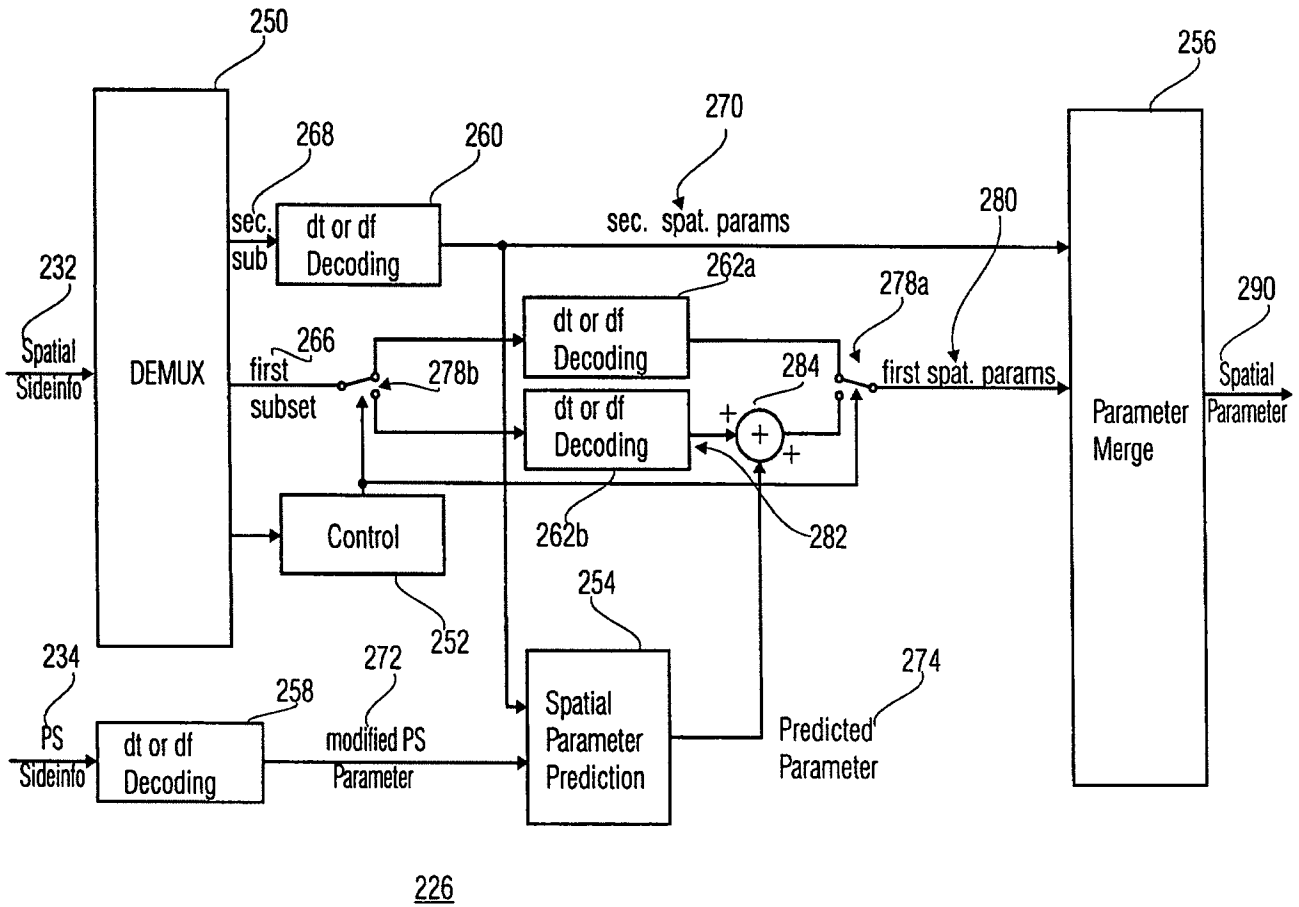
FIG. 7 is details of the inventive multi-channel decoder of FIG. 6.

FIG. 7 gives a detailed description of the parameter reconstructor 226 used by the multi-channel audio decoder 220. The parameter reconstructor 226 is comprising a spatial parameter disassembler 250, a control unit 252, a spatial parameter predictor 254, a spatial parameter assembler 256 and a first differential decoder 258, a second differential decoder 260, a third differential encoder 262*a*, and a fourth differential decoder 262*b*.

The spatial parameter disassembler 250 receives the information on the set of spatial parameters 232 as an input and derives a first subset 266 and a second subset 268 from the information on the set of spatial audio parameters 232. The first subset 266 comprises the parameters that are possibly being represented by a predictive differential representation performed on the encoder side, and the second subset 268 comprises a subset of the information on the set of spatial parameters that is transmitted unmodified within the bitstream.

Furthermore, the control unit 252 optionally receives control information from the spatial parameter disassembler, indicating whether a predictive differential representation had been used during encoding or not. This information is optional in the sense that the control unit 252 could alternatively derive, using appropriate algorithms, whether such a prediction had been performed or not without having access to an indicating parameter.

The second subset of parameters 268 is input into the second differential decoder 260, that differentially decodes the second subset to derive a second subset of spatial parameters 270.

The first differential decoder 258 receives as an input the decoder usable stereo parameters 234, to derive parametric stereo parameters 272 from the encoded representation. The spatial parameter predictor 254 is operating in the same way as its counterpart on the encoder side, therefore it receives as a first input the parametric stereo parameters 272 and as a second input the second subset of spatial parameters 270 to derive predicted parameters 274.

The control unit 252 controls two possible different data paths for the first subset of the information on the set of spatial parameters. When the control unit 252 indicates that the first subset of the information of the set of spatial parameters had not been transmitted using predictive differential coding, the control unit 252 steers switches 278*a* and 278*b* such, that the first subset 266 is input into the third differential decoder 262*a* to derive a first subset of the set of spatial parameters 280 without applying inverse prediction. The first subset of spatial parameters 280 is then input into the spatial parameter assembler 256 at a second input of the same.

If, however, the control unit 252 indicates differentially predicted parameters, the first subset 266 of the information of the set of spatial parameters is input into the fourth differential decoder 262*b* to derive a differentially predicted representation of the first subset 266 at an output 282 of the differential decoder. Then, the sum of the differential representation and the predicted parameters 274 is computed by an adder 284, thus reversing the differential prediction operation performed on an encoder side. As a result, the first set of spatial parameters 280 is available at the second input of the spatial parameter assembler 256. The spatial parameter assembler 256 combines the first set of spatial parameters 280 and the second set of spatial parameters 270 to provide a full set of spatial parameters 290 at its output, which is the basis of a multi-channel reconstruction of an encoded signal.

Summarizing, FIG. 7 illustrates the joint decoding block which takes both the spatial side info and the PS side info as input and reconstructs the spatial parameter. A demultiplexer separates the spatial side info in an encoded second subset of spatial parameter and encoded first subset of spatial parameter and control information. The decoding block takes the encoded second subset of spatial parameter as input and reconstructs this parameter subset. This includes Huffman decoding and time-differential (dt) or frequency-differential (df) decoding in case such coding was employed in the encoder. The decoding block takes the PS side info as input and reconstructs the (modified) PS parameter. The spatial parameter prediction block takes the second subset of the spatial parameter and the (modified) PS parameter as input and calculates predicted values for the first subset of the spatial parameter in the same way as done by its counterpart in the encoder. The control block determines which selection decision was taken by its counterpart, the control block in the encoder. Depending on this selection, the encoded first subset of spatial parameter is either decoded directly or decoded taken into account the prediction. In both cases, this includes Huffman decoding and time or frequency-differential decoding in case such coding was employed in the encoder. In case the control block determined that no prediction was used, the output of decoding block is taken as the reconstructed first subset of spatial parameter. Otherwise, the output of decoding block contains the prediction error values which are then added to the predicted parameter values as generated by the spatial parameter prediction in order to obtain the original values of the first subset of spatial parameters. Finally the reconstructed first and second subset of spatial parameters are merged to form the full set of spatial parameters.

Figure 8:
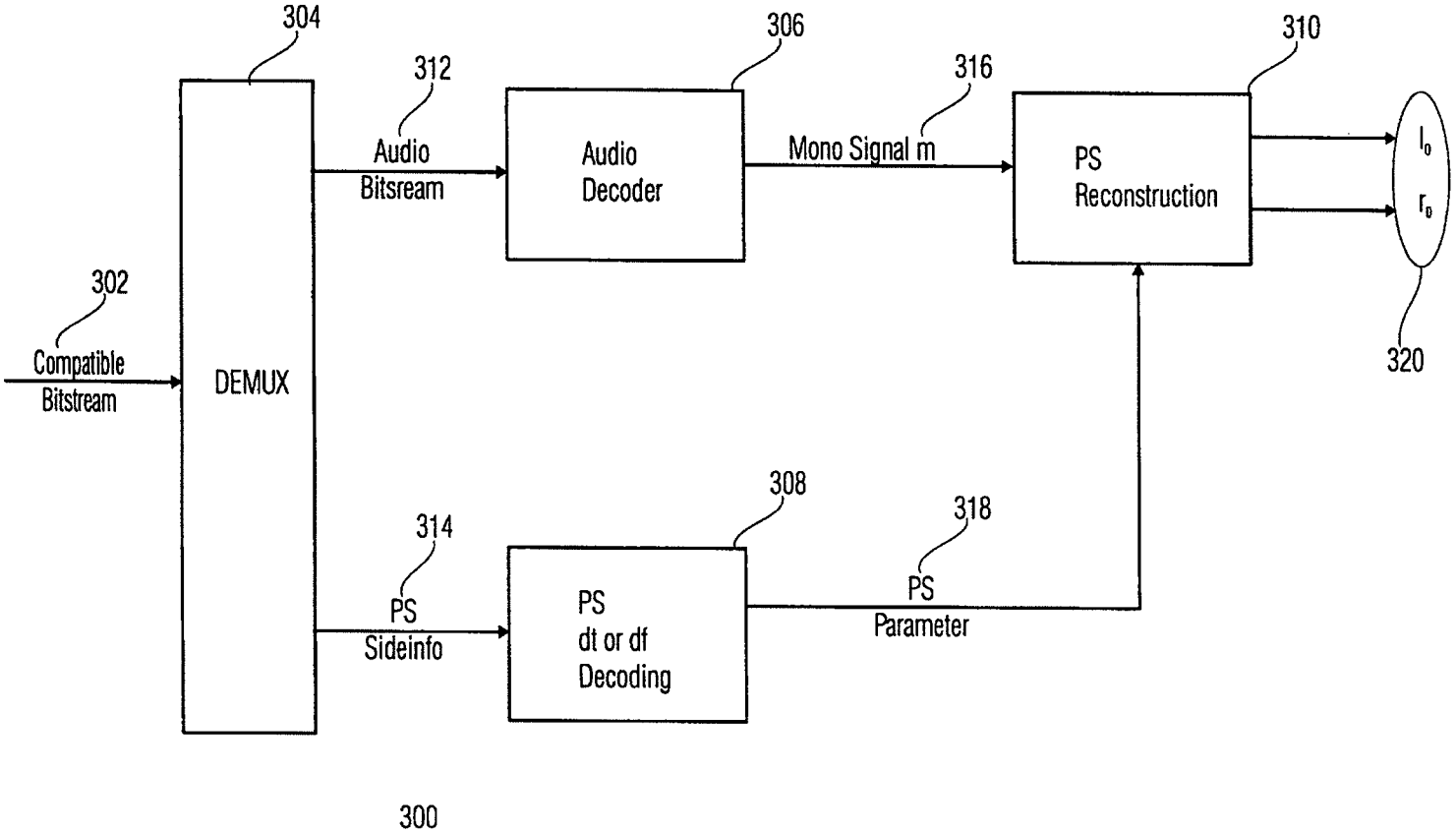
FIG. 8 is the backwards compatibility of an inventive signal.

FIG. 8 illustrates, how a compatible inventive bitstream is processed by a legacy parametric stereo decoder to derive a stereo upmix of a signal to emphasize the great advantage of the full backwards compatibility of the inventive concept.

A parametric stereo decoder 300 is receiving a compatible bitstream 302 as input. The parametric stereo decoder 300 is comprising a demultiplexer 304, an audio decoder 306, a differential decoder 308 and an upmixer 310. The demultiplexer 304 derives an audio bitstream 312 and decoder usable parametric stereo parameters 314 from the compatible bitstream 302.

As the parametric stereo decoder 300 cannot operate on spatial audio parameters, the demultiplexer 304 simply neglects the spatial audio parameters comprised within the compatible bitstream 302, for example by skipping header fields and associated data sections within the bitstream not known to the decoder. The audio bitstream 312 is input into the audio decoder 306 that derives a monophonic downmix signal 316 whereas the decoder usable stereo parameters 314 are differentially decoded by the differential decoder 308 to derive parametric stereo parameters 318. The monophonic downmix signal 316 and the parametric stereo parameters 318 are input into the upmixer 310, that derives a stereo upmix signal 320 using the monophonic downmix signal 316 and the parametric stereo parameters 318.

In other words, FIG. 8 illustrates a parametric stereo (PS) decoder that takes a compatible bitstream as input and generates a 2-channel stereo audio signal, comprising the channels l0 and r0. First a demultiplexer takes the compatible bitstream as input and decomposes it into an audio bitstream and the PS side info. Since the spatial side info was embedded in the compatible bitstream in a backward compatible manner, it does not affect the demultiplexer. If perceptual audio coding was applied to the mono signal, a corresponding audio decoder takes the audio bitstream as input and generates the decoded mono audio signal m, subject to distortion as introduced by the perceptual audio codec. The PS decoding block takes the PS side info as input and reconstructs the PS parameter. This includes Huffman decoding and time-differential (dt) or frequency-differential (df) decoding in case such coding was employed in the encoder. Finally the PS reconstruction takes the decoded mono signal m and the PS parameters as input and reconstructs the 2-channel stereo signal.

Figure 9:
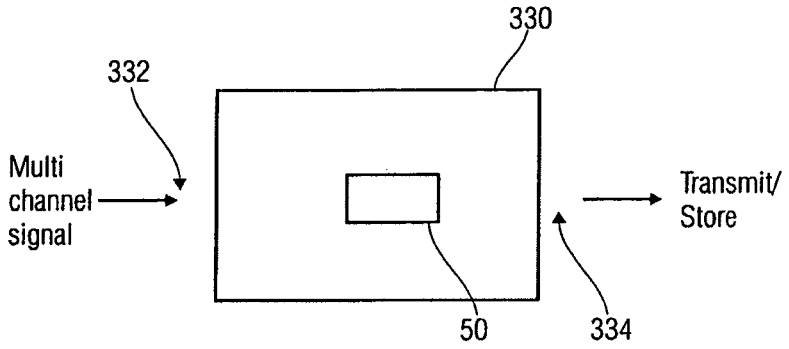
FIG. 9 is a transmitter or audio recorder having an inventive encoder.

FIG. 9 is showing an inventive audio transmitter or recorder 330 that is having an audio encoder 10, an input interface 332 and an output interface 334.

An audio signal can be supplied at the input interface 332 of the transmitter/recorder 330. The audio signal is encoded by an inventive encoder 10 within the transmitter/recorder and the encoded representation is output at the output interface 334 of the transmitter/recorder 330. The encoded representation may then be transmitted or stored on a storage medium.

Figure 10:
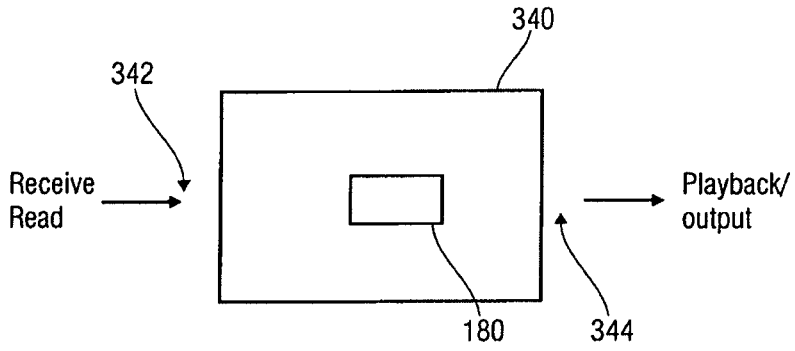
FIG. 10 is a receiver or audio player having an inventive multi-channel decoder.

FIG. 10 shows an inventive receiver or audio player 340, having an inventive audio decoder 180, a bit stream input 342, and an audio output 344.

A bit stream can be input at the input 342 of the inventive receiver/audio player 340. The bit stream then is decoded by the decoder 180 and the decoded signal is output or played at the output 344 of the inventive receiver/audio player 340.

Figure 11:
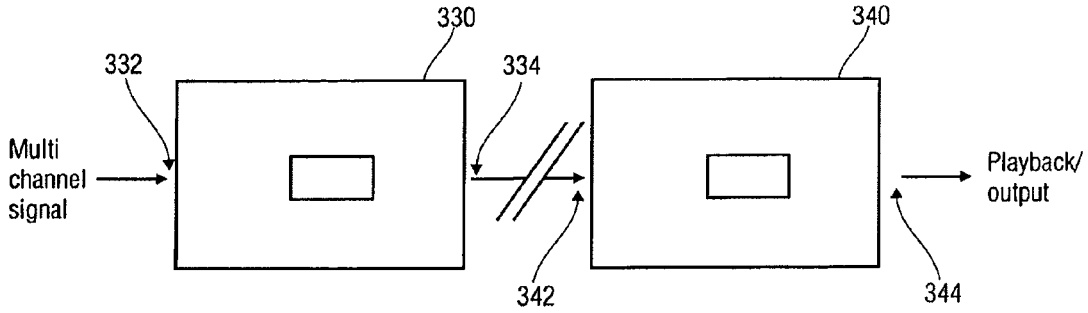
FIG. 11 is a transmission system.

FIG. 11 shows a transmission system comprising an inventive transmitter 330, and an inventive receiver 340.

The audio signal input at the input interface 332 of the transmitter 330 is encoded and transferred from the output 334 of the transmitter 330 to the input 342 of the receiver 340. The receiver decodes the audio signal and plays back or outputs the audio signal on its output 344.

Summarizing the inventive concept, one can say, that the present invention relates to coding of multi-channel representations of audio signals using spatial audio parameters in a manner that is compatible with coding of 2-channel stereo signals using parametric stereo parameters. The present invention teaches new methods for efficient coding of both spatial audio parameters and parametric stereo parameters and for embedding the coded parameters in a bitstream in a backward compatible manner. In particular it aims at minimizing the overall bitrate for the parametric stereo and spatial audio parameters in backward compatible bitstream without compromising the quality of the decoded stereo or multi-channel audio signal. However, when a slightly compromised quality of the decoded stereo signal is acceptable, the overall bitrate can be reduced further.

Although the bitstreams describing the backwards compatibility of the inventive signal and the generation of the same do not comprise parameters describing the monophonic downmix signal, it goes without saying that such parameters can be easily incorporated into the bitstream shown.

Arbitrary numbers of the spatial audio parameters can be predicted by using parametric stereo parameters if one is able to derive an appropriate rule to predict the parameters. Therefore, the detailed prediction rules given above are to be understood as examples only. It is clear that other prediction rules can lead to the same bit saving effect and, therefore, the present invention is by no means limited to using one of the prediction rules described above.

Although a parametric stereo downmixer 58 which derives a stereo downmix of a multi-channel signal does exist in the examples of inventive encoders given, in practical implementations, the stereo downmixer can be omitted, if the downmixing rule is known, and when, therefore, the parametric stereo parameters can be derived from the multi-channel signal directly.

In the given implementations, the monophonic downmix signal is further encoded by an audio encoder or decoded on a decoder side. The encoding and decoding is optional, i.e. omitting a further compression of the monophonic downmix signal will also yield inventive encoders and decoders incorporating the inventive concept.

The control unit within the inventive encoders and decoders may be omitted and one may go for a general decision to represent subsets of spatial parameters by differential predicted parameters at the benefit of saving the control unit and at the cost of accepting a slightly higher bit rate for the rare cases, when the differential predicted representation does not save transmission bit rate.

Although, within the given examples, additional encoders applied in the signal paths are referred to as differential encoders or differential decoders only, it is understood, that any other appropriate encoder or decoder suited to compress the parameters may also be used, especially a combination of a differential de- or encoder and a Huffman de- or encoder. Such a combination is used in a way, that firstly the parameters are differentially encoded and then the differentially encoded parameters are Huffman encoded, which finally results in a parametric representation using smaller bit rates, since the differentially predicted representation in general has lower entropy than the spatial parameters underlying themselves.

Summarizing the inventive ideas, the present invention teaches the following:

In a first aspect a method for compatible coding of multi-channel audio signals, characterized by: at the encoder side, downmixing the multi-channel signal to a one channel representation; at the encoder side given said multi-channel signal, define parameters representing the multi-channel signal; at the encoder side given said multi-channel signal, define parameters representing a stereo downmix of the multi-channel signal; at the encoder side, embed both sets of parameters in a bitrate efficient and backward compatible manner in a bitstream; at the decoder side, extract the embedded parameters from a bitstream; at the decoder side, reconstruct parameters representing a multi-channel signal from the parameters extracted from the bitstream; at the decoder side, reconstruct the multi-channel output signals given the parameters reconstructed from the bitstream data, and said downmixed signal.

As a second aspect a method according to the first aspect, characterized by embedding the parameters representing a stereo downmix in the bitstream, such that they can be decoded by a (legacy) decoding method that only supports parametric stereo decoding.

As a third aspect a method according to the first aspect, characterized by splitting the set of parameters representing the multi-channel signal in a first subset and a second subset.

As a fourth aspect a method according to the third aspect, characterized by a prediction of the values in said first subset of parameters based on said second subset of parameters and based on the parameters that represent a stereo downmix of the multi-channel signal.

As a fifth aspect a method according to the fourth aspect, characterized by a control method that automatically selects whether the first subset of parameters is encoded directly or whether only the differences relative to the predicted parameter values are encoded.

As a sixth aspect a method according to the third aspect, characterized by modification of the parameters that present a stereo downmix, where both the original parameters representing the multi-channel signal and the original parameters representing the stereo downmix are used as basis to derive the modified parameters.

As a seventh aspect a method according to the fourth aspect, characterized by a look-up table being used to find said predicted parameter values.

As an eight aspect a method according to the fourth aspect, where in the fourth aspect polynomial function is being used to find said predicted parameter values.

As a ninth aspect a method according to the fourth aspect, characterized by mathematical function derived from the method employed to generate the stereo downmix being used to find said predicted parameter values.

As a tenth aspect an apparatus for encoding a representation of a multi-channel audio signal, characterized by: means for downmixing the multi-channel signal to a one channel representation; means for defining parameters representing the multi-channel signal; means for defining parameters representing a stereo downmix of the multi-channel signal; means for embedding both sets of parameters in a bitrate efficient and backward compatible manner in a bitstream.

As an eleventh aspect an apparatus for reconstructing a multi-channel signal based on a down-mixed signal and corresponding parameter sets, characterized by: means for extracting the parameter sets embedded in a bitstream; means for reconstructing parameters representing a multi-channel signal from the parameters extracted from the bitstream; means for reconstructing the multi-channel output signal given the parameter set reconstructed from the bitstream data, and said downmixed signal.

Depending on certain implementation requirements of the inventive methods, the inventive methods can be implemented in hardware or in software. The implementation can be performed using a digital storage medium, in particular a disk, DVD or a CD having electronically readable control signals stored thereon, which cooperate with a programmable computer system such that the inventive methods are performed. Generally, the present invention is, therefore, a computer program product with a program code stored on a machine readable carrier, the program code being operative for performing the inventive methods when the computer program product runs on a computer. In other words, the inventive methods are, therefore, a computer program having a program code for performing at least one of the inventive methods when the computer program runs on a computer.

While this invention has been described in terms of several preferred embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

The invention claimed is:

1. Multi-channel audio decoder for processing a parametric representation, wherein the parametric representation is comprising information on one or more spatial parameters describing spatial properties of a multi-channel signal and a stereo parameter describing spatial properties of a stereo downmix of the multi-channel signal, wherein the information on the one or more spatial parameters and the stereo parameter, when combined using a combination rule, results in one or more spatial parameters, the decoder comprising:

a parameter reconstructor for combining the stereo parameter and the information on the one or more spatial parameters using the combination rule to obtain the one or more spatial parameters.

2. Multi-channel audio decoder according to claim 1, in which the combination rule is such that the combination comprises a replacement of a first subset of parameters of the information on the one or more spatial parameters by replacement parameters derived by combining the stereo parameter and the first subset of the parameters.

3. Multi-channel audio decoder in accordance with claim 2, in which the combination rule is such that a replacement parameter is derived by a linear combination of the corresponding parameter from the first subset of parameters and of a prediction of the same parameter, wherein the prediction is derived using parameters of a second subset of the information on the one or more spatial parameters and the stereo parameter, combining them using a prediction rule.

4. Multi-channel audio decoder in accordance with claim 3, in which the prediction rule is such that the prediction is derived using the stereo parameter.

5. Multi-channel audio decoder in accordance with claim 4, in which the prediction rule is such that the stereo parameter is used as the prediction of the spatial parameter.

6. Multi-channel audio decoder in accordance with claim 1, in which the stereo parameter is comprising a first parameter $P_1$ describing an intensity difference between the channels of the stereo downmix and a second parameter $P_2$ describing a correlation between the channels of the stereo down mix;

in which a second subset of parameters is comprising a parameter $S_3$ describing an intensity difference between a sum of a left channel and a right channel of the multi-channel signal and a center channel of the multi-channel signal; and in which the prediction rule is such that a parameter $S_1$ of a first subset of parameters, the parameter describing an intensity difference between the left channel and the right channel of the multi-channel signal, is predicted by a prediction parameter $\hat{S}_1$ based on the following formulas:

$\hat{S}_1=\sqrt{\hat{X}/\hat{Y}}$, wherein $$\hat{X} = \frac{P_1^2 S_3^2 + q^2(P_1^2 - 1)}{P_1^2 + 1}, \hat{Y} = \frac{S_3^2 - q^2(P_1^2 - 1)}{P_1^2 + 1}.$$

7. Multi-channel audio decoder in accordance with claim 1, in which the parameter reconstructor is further comprising a decision unit for deciding whether a first subset of parameters is replaced by replacement parameters or not.

8. Multi-channel audio decoder in accordance with claim 1, further comprising a bitstream decomposer to decompose a representation of the stereo parameter and a representation of the information on the one or more spatial parameters from a bitstream, wherein the bitstream is backwards compatible to be processible by legacy parametric stereo devices.

9. Multi-channel audio decoder in accordance with claim 8, further comprising an entropy decoder and a differential decoder to derive the stereo parameter and the information on the one or more spatial parameters from the representation of the stereo parameter and from the representation of the information on the one or more spatial parameters.

10. Multi-channel audio decoder in accordance with claim 8, in which the bitstream decomposer is further operative to decompose a monophonic downmix signal from the bitstream, the monophonic downmix signal being a monophonic downmix of the multi-channel signal; and which is further comprising an upmixer for deriving a reconstruction of the multi-channel signal using the downmix signal and the one or more parameters.

11. Multi-channel audio decoder in accordance with claim 10, further comprising an audio decoder for deriving the monophonic downmix signal from an encoded representation of the monophonic downmix signal decomposed from the bitstream.

12. Method for processing a parametric representation, wherein the parametric representation is comprising information on a one or more spatial parameters describing spatial properties of a multi-channel signal and a stereo parameter describing spatial properties of a stereo-downmix of the multi-channel signal, wherein the information on the one or more spatial parameters and the stereo parameters, when combined using a combination rule, results in the one or more spatial parameters, the method comprising:

combining the stereo parameter and the information on the one or more spatial parameters using the combination rule to obtain the one or more spatial parameters.

13. Receiver or audio player having a multi-channel audio decoder for processing a parametric representation, wherein the parametric representation is comprising information on one or more spatial parameters describing spatial properties of a multi-channel signal and a stereo parameter describing spatial properties of a stereo downmix of the multi-channel signal, wherein the information on the one or more spatial parameters and the stereo parameter, when combined using a combination rule, results in one or more spatial parameters, the decoder comprising:

a parameter reconstructor for combining the stereo parameter and the information on the one or more spatial parameters using the combination rule to obtain the one or more spatial parameters.

14. Method of receiving or audio playing, the method having a method for processing a parametric representation, wherein the parametric representation is comprising information on a one or more spatial parameters describing spatial properties of a multi-channel signal and a stereo parameter describing spatial properties of a stereo-downmix of the multi-channel signal, wherein the information on the one or more spatial parameters and the stereo parameters, when combined using a combination rule, results in the one or more spatial parameters, the method comprising:

combining the stereo parameter and the information on the one or more spatial parameters using the combination rule to obtain the one or more spatial parameters.

15. Digital storage medium having stored thereon a computer program for performing, when running on a computer, a method for processing a parametric representation, wherein the parametric representation is comprising information on a one or more spatial parameters describing spatial properties of a multi-channel signal and a stereo parameter describing spatial properties of a stereo-downmix of the multi-channel signal, wherein the information on the one or more spatial parameters and the stereo parameters, when combined using a combination rule, results in the one or more spatial parameters, the method comprising:

combining the stereo parameter and the information on the one or more spatial parameters using the combination rule to obtain the one or more spatial parameters.

* * * * *

UNITED STATES PATENT AND TRADEMARK OFFICE

CERTIFICATE OF CORRECTION

PATENT NO. : 8,654,985 B2
APPLICATION NO. : 13/040057
DATED : February 18, 2014
INVENTOR(S) : Lars Villemoes et al.

It is certified that error appears in the above-identified patent and that said Letters Patent is hereby corrected as shown below:

On the title page, item (73), the second Assignee should be added --Koninklijke Philips Electronics N.V., Eindhoven (NL)--

Signed and Sealed this
Sixteenth Day of September, 2014

Michelle K. Lee

Michelle K. Lee
*Deputy Director of the United States Patent and Trademark Office*